US006839986B2

(12) United States Patent
Chen et al.

(10) Patent No.: US 6,839,986 B2
(45) **Date of Patent: *Jan. 11, 2005**

(54) SHOE HAVING A WATERPROOF TONGUE

(75) Inventors: Eddie Chen, 9F, No. 201, Sec. 1, Taichung-Kang Rd, Taichung City (TW); Phil Chang, Taichung (TW)

(73) Assignee: Eddie Chen, Taichung (TW)

( * ) Notice: Subject to any disclaimer, the term of this patent is extended or adjusted under 35 U.S.C. 154(b) by 70 days.

This patent is subject to a terminal disclaimer.

(21) Appl. No.: 10/285,248

(22) Filed: Oct. 30, 2002

(65) Prior Publication Data

US 2004/0083624 A1 May 6, 2004

(51) Int. Cl.[7] ..... A43B 23/26
(52) U.S. Cl. ..... 36/54; 36/55; 36/51
(58) Field of Search ..... 36/10, 55, 45, 36/54, 51

(56) References Cited

U.S. PATENT DOCUMENTS

| | | | | | |
|---|---|---|---|---|---|
| 2,039,287 | A | | 5/1936 | Arnold | 12/142 |
| 2,201,383 | A | | 5/1940 | Vizard | 36/17 |
| 3,076,274 | A | * | 2/1963 | Schlecht | 36/54 |
| D341,481 | S | | 11/1993 | Peterson | D2/320 |
| 5,384,971 | A | * | 1/1995 | Ferry | 36/105 |
| RE34,890 | E | * | 4/1995 | Sacre | 36/55 |
| 5,469,640 | A | * | 11/1995 | Nichols | 36/50.1 |
| D383,893 | S | | 9/1997 | Leick | D2/897 |
| D385,987 | S | | 11/1997 | Bramani | D2/959 |
| 5,802,740 | A | * | 9/1998 | Merk, Sr. | 36/55 |
| D402,095 | S | | 12/1998 | Cretinon | D2/957 |
| D414,023 | S | | 9/1999 | Cretinon et al. | D2/957 |
| D414,594 | S | | 10/1999 | Parisotto | D2/959 |
| 5,964,047 | A | | 10/1999 | Covatch | 36/55 |
| D416,669 | S | | 11/1999 | Parr et al. | D2/954 |
| D420,497 | S | | 2/2000 | Panella | D2/957 |
| 6,065,227 | A | * | 5/2000 | Chen | 36/4 |
| D433,791 | S | | 11/2000 | Laberge | D2/957 |
| D434,550 | S | | 12/2000 | LaBerge | D2/957 |
| D439,031 | S | | 3/2001 | Matis et al. | D2/959 |
| D440,749 | S | | 4/2001 | Rogers | D2/959 |
| D442,768 | S | | 5/2001 | Matis | D2/957 |
| 6,305,101 | B2 | | 10/2001 | Chemello | 36/10 |
| D450,428 | S | | 11/2001 | Cretinon et al. | D2/953 |
| 6,367,166 | B1 | * | 4/2002 | Barthelemy et al. | 36/3 R |
| D456,982 | S | | 5/2002 | Rogers | D2/957 |
| D460,608 | S | | 7/2002 | Laberge et al. | D2/957 |
| 6,412,193 | B1 | | 7/2002 | Chen | 36/14 |
| D462,157 | S | | 9/2002 | Burt | D2/953 |
| D467,712 | S | | 12/2002 | Delgorgue et al. | D2/957 |
| D468,083 | S | | 1/2003 | Morais | D2/960 |
| 2003/0093919 | A1 | | 5/2003 | Wang | 36/10 |
| 2003/0200679 | A1 | * | 10/2003 | Wilson et al. | 36/55 |

OTHER PUBLICATIONS

U.S. Appl. No. 10/241,919, Chen, filed Sep. 12, 2002.
U.S. Appl. No. 29/167,920, Chen et al., filed Sep. 23, 2002.
U.S. Appl. No. 10/267,429, Chen et al., filed Oct. 8, 2002.
U.S. Appl. No. 10/303,136, Chen et al., filed Nov. 21, 2002.

* cited by examiner

*Primary Examiner*—M. D. Patterson
(74) *Attorney, Agent, or Firm*—Ladas & Parry LLP

(57) ABSTRACT

A shoe includes an upper which has a substantially U-shaped first notched edge, a first cutout confined by the first notched edge, and a connection seam spaced apart from and extending around the first notched edge, an inner lining which is disposed inside the upper and has a second notched edge corresponding in position to the first notched edge; and a tongue which is waterproof and which has a marginal end. The marginal end of the tongue is attached to the upper along the connection seam and is attached to the inner lining along the second notched edge.

7 Claims, 9 Drawing Sheets

SHOE HAVING A WATERPROOF TONGUE

BACKGROUND OF THE INVENTION

1. Field of the Invention

This application relates to a shoe, more particularly to a shoe incorporating a waterproof tongue that can prevent entry of water through the tongue of the shoe.

2. Brief Description of the Related Art

As shown in FIG. 1, a conventional waterproof shoe includes an upper 1 made of a waterproof material and united with an outsole 2, a waterproof inner lining 3, a tongue 4, and an eyelet unit 5. A substantially U-shaped eyelet plate 101 has an inner edge 1011 and an outer edge 1012 which is spaced apart from and extends around the inner edge 1011. The eyelet plate 101 is sewn to the upper 1 along the outer edge 1012. The inner lining 3 has a notched edge 301 with a contour conforming to that of the inner edge 1011 of the eyelet plate 101. The tongue 4 is waterproof and has a peripheral edge sewn to both of the eyelet plate 101 and the inner lining 3 along the inner edge 1011 and along the notched edge 301. The resulting sewing seam thereof is sealed to be watertight by means of a watertight sealing member, such as a waterproof tape or a waterproof adhesive. The eyelet unit 5 includes upper and lower eyelet elements 501 and 502 which are formed between the inner and outer edges 1011 and 1012.

Although the aforesaid waterproof shoe can prevent entry of water through the tongue 4, it encounters the following drawbacks:

1. In fabricating the shoe, the lower eyelet elements 502 are attached to the eyelet plate 101 before the inner lining 3 is sewn to the upper 1. Since the lower eyelet elements 502 extend through the eyelet plate 101, the eyelet plate 101 is not waterproof. In addition, since the peripheral edge of the tongue 4 is sewn to the inner edge of the eyelet plate 101, the tongue 4 does not block the holes of the eyelet elements 502, and water can enter through the eyelet elements 502. Therefore, it is necessary to provide a waterproof sealing tape or adhesive on the inner surface of the eyelet plate 101 at a location corresponding to the position of the lower eyelet elements 502, thus complicating the manufacturing process and resulting in an increased cost.

2. The upper eyelet elements 501 are attached to the eyelet plate 101 after the inner lining 3 is sewn to the upper 1 in order to provide the inner lining 3 with a neat and smooth appearance. Since these upper eyelet elements 501 extend through both of the eyelet plate 101 and inner lining 3, the waterproofing characteristic of the shoe is destroyed. On the other hand, because the peripheral end of the tongue 4 is sewn to the inner edge 1011 of the eyelet plate 101, the tongue 4 does not any portion that overlaps the eyelet plate 101 to prevent water from entering through the eyelet plate 101. As a result, the waterproofing effect of the shoe is insufficient and can only be realized in the lower portion of the shoe below the upper eyelet elements 501.

SUMMARY OF THE INVENTION

An object of the present invention is to provide a waterproof shoe with an improved construction by which water invasion can be prevented effectively in a region where a tongue and eyelet elements are provided.

Accordingly, a shoe according to the present invention comprises: an upper which has a top end, a substantially U-shaped first notched edge extending downward from the top end, a first cutout confined by the first notched edge, and a connection seam extending along and spaced apart from the first notched edge, the connection seam extending around the first notched edge; an inner lining disposed inside the upper and having a second notched edge; and a tongue which is waterproof and which has a marginal end. The marginal end is contoured to substantially conform to the connection seam, is attached to the upper along the connection seam and is attached to the inner lining along the second notched edge.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
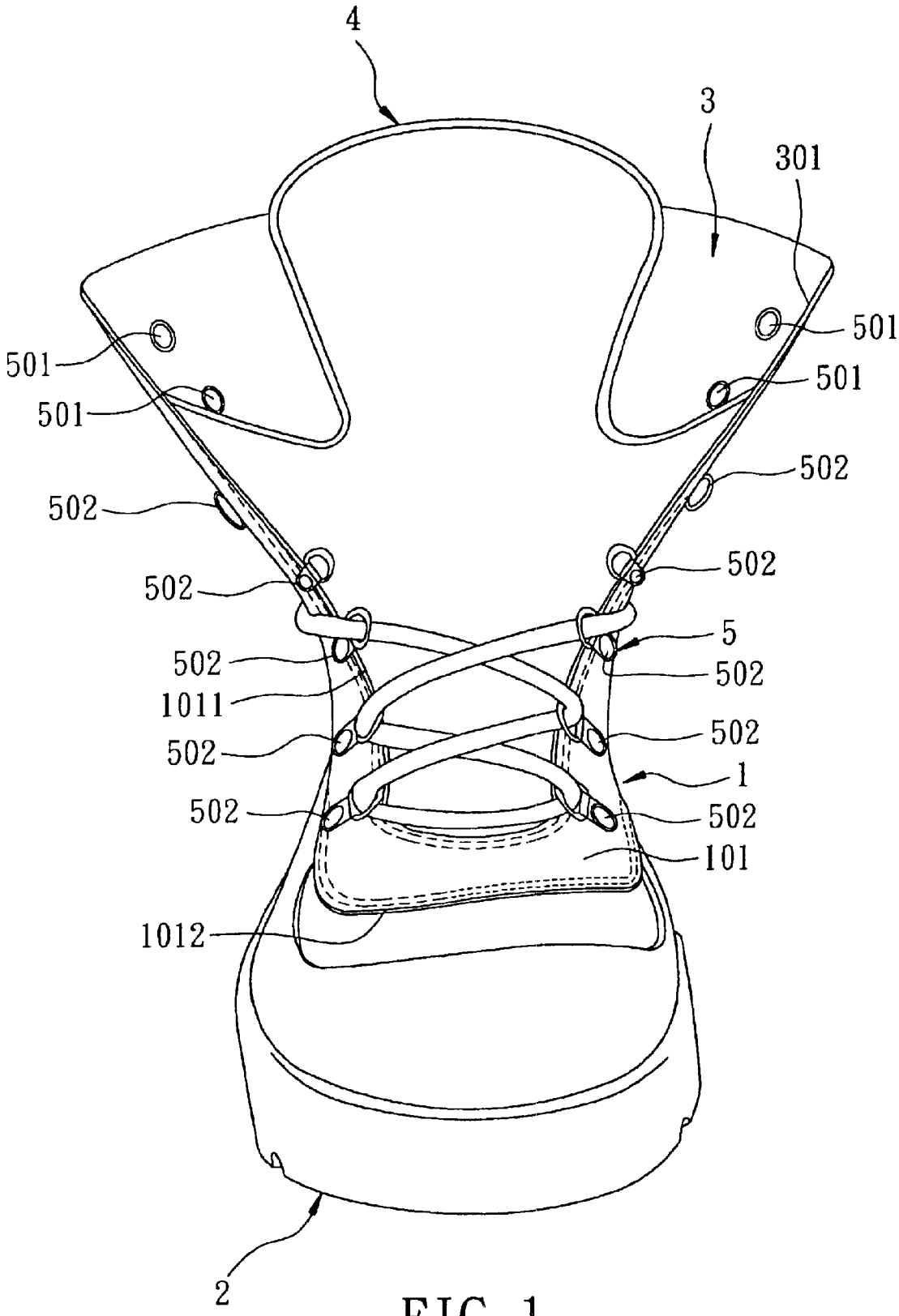
FIG. 1 shows a conventional waterproof shoe.
Figure 2:
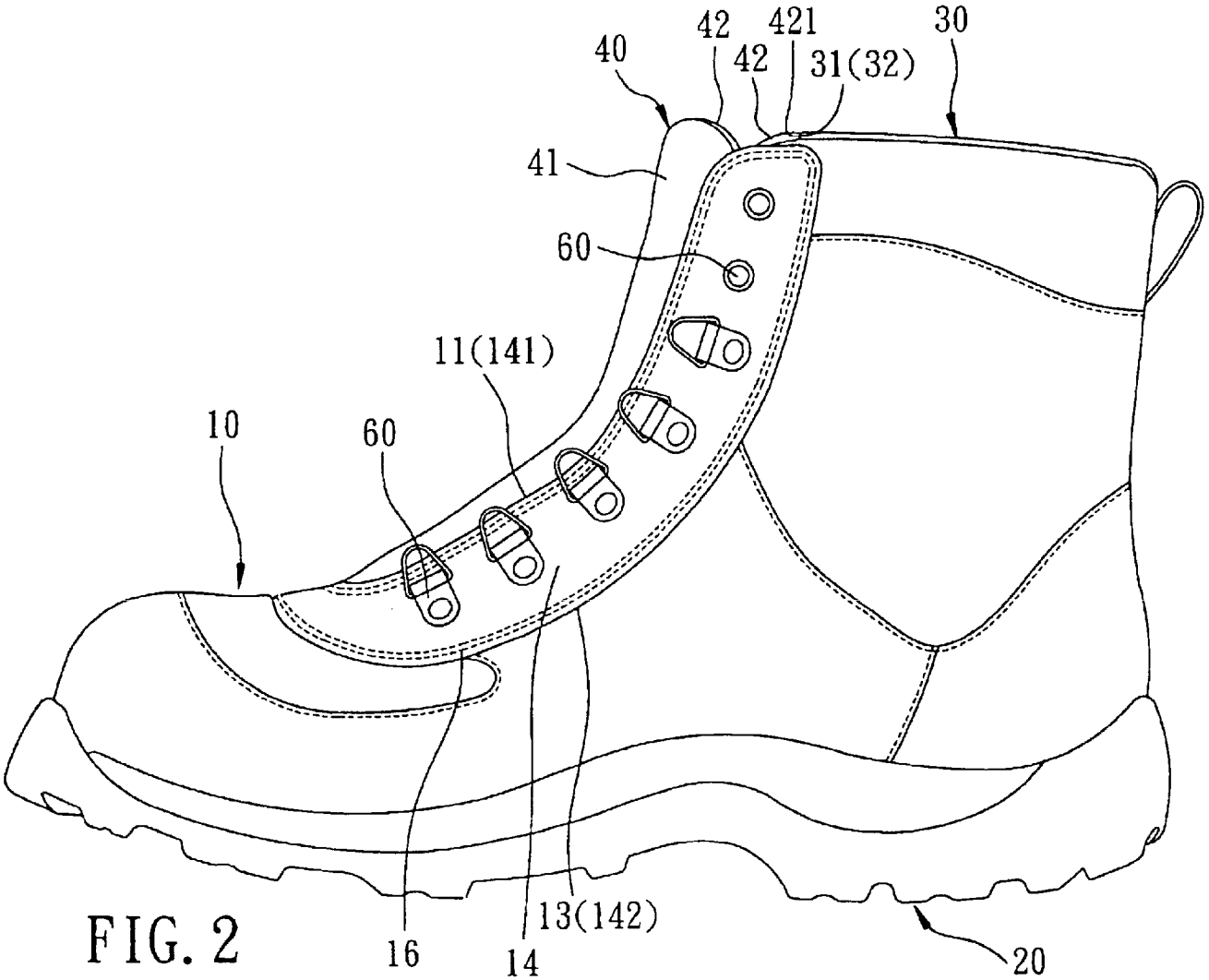
FIG. 2 is a side elevation view of a first embodiment of the present invention.
Figure 3:
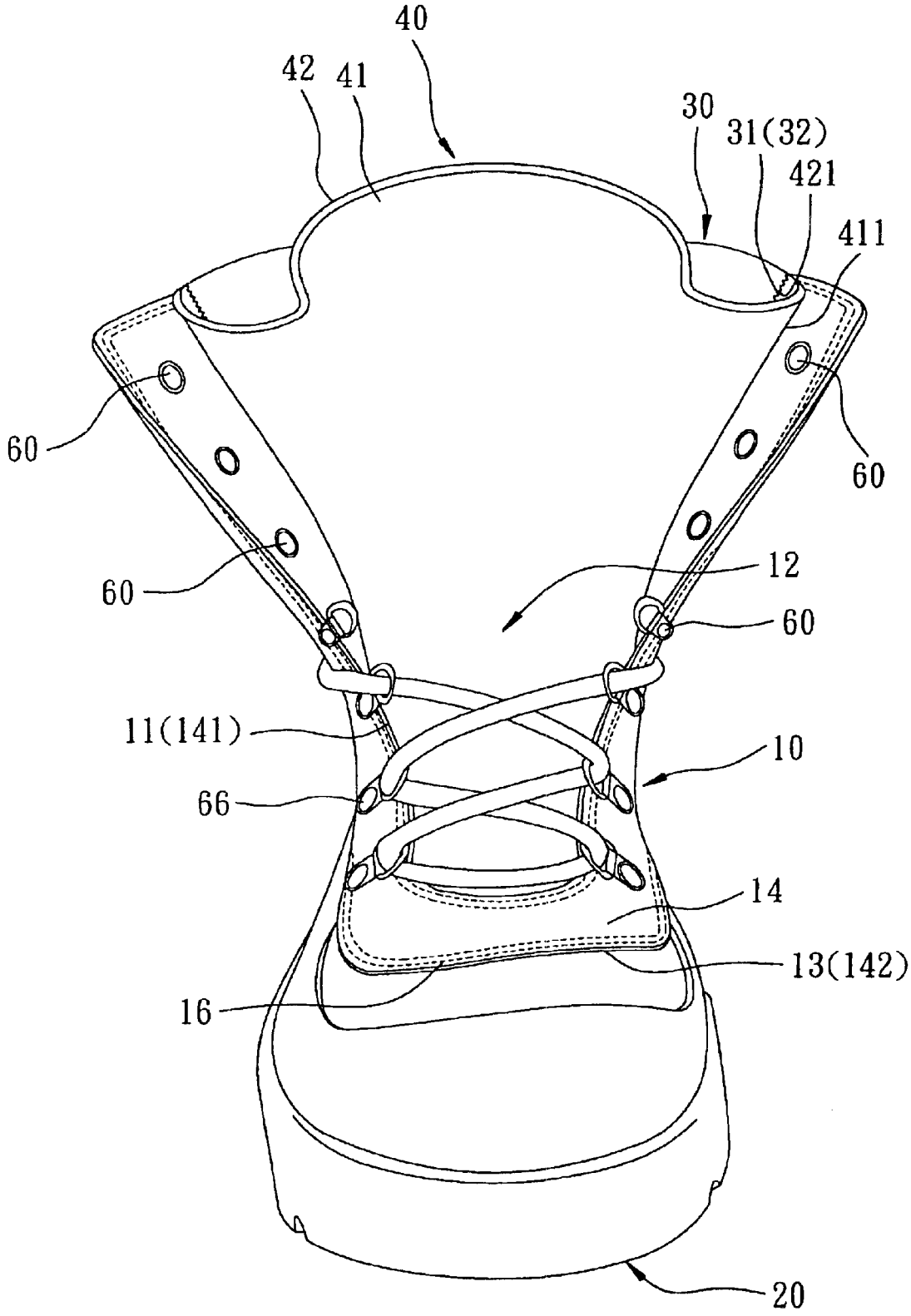
FIG. 3 is a front elevation view of the first embodiment.
Figure 4:
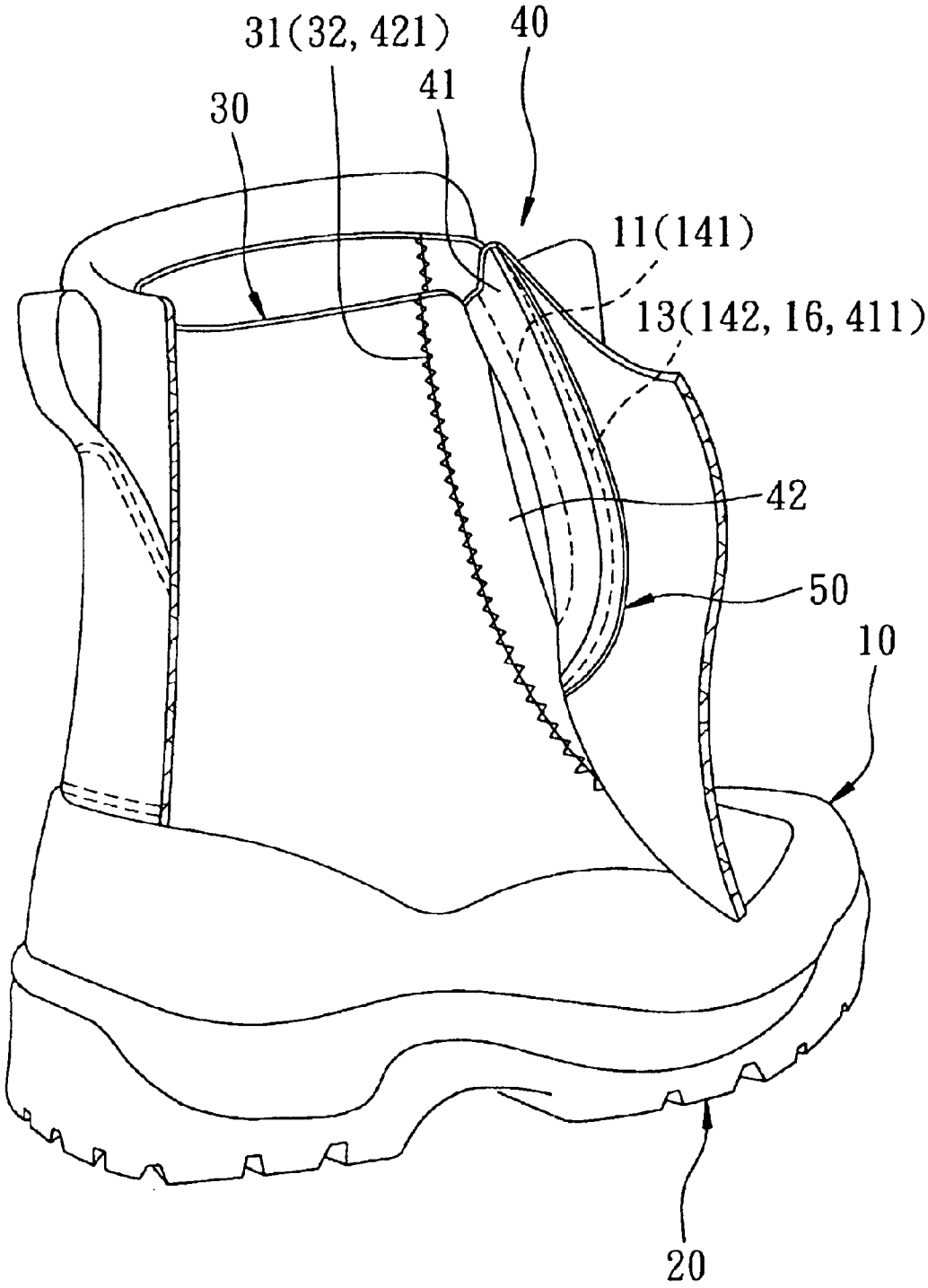
FIG. 4 is a partially sectioned view of the first embodiment.

Referring to FIGS. 2, 3 and 4, a first embodiment of the shoe according to the present invention is shown to include an upper 10, an outsole 20, an inner lining 30, a tongue 40, a watertight sealing tape 50, and a plurality of eyelet elements 60.

The upper 10 in this embodiment is made of a breathable material such as leather or a textile material. The upper 10 has a U-shaped first notched edge 11 which extends downward from the top end of the upper 10 to confine a cutout 12 in an instep part of the upper 10. The upper 10 further has a U-shaped eyelet plate 14 which includes a U-shaped inner edge 141 and a U-shaped outer edge 142 spaced apart from and extending around the inner edge 141. The outer edge 142 of the eyelet plate 14 is sewn to the remaining part of the upper 10, thus forming a substantially U-shaped connection seam 13. The inner edge 141 of the eyelet plate 14 defines the first notched edge 11 of the upper 10, which confines the cutout 12. The connection seam 13 is spaced apart from the inner edge 141 or the first notched edge 11 and thus extends around the inner edge 141 or the first notched edge 11.

The outsole 20 is attached to the bottom end of the upper 10. The inner lining 30 is made of a waterproof material and is disposed inside the upper 10. The inner lining 30 includes a second notched edge 31 corresponding in position to the cutout 12 of the upper 10. The top end of the inner lining 30 is sewn to the top end of the upper 10.

The tongue 40 is made of an elastic and stretchable waterproof material, such as neoprene. The tongue 40 has an outer layer 41 with an outer marginal end 411, and an inner layer 42 with an inner marginal end 421. The outer and inner layers 41, 42 are sewn together at the top ends thereof. The outer marginal end 411 of the outer layer 41 and the inner marginal end 421 of the inner layer 42 cooperate to define a marginal end of the tongue 40. The outer marginal end 411 of the outer layer 41 is sewn to the upper 10 along the connection seam 13 to form a first seam 16. The inner marginal end 421 of the inner layer 42 is sewn to the inner lining 30 along the second notched edge 31 of the inner lining 30 to form a second seam 32. Furthermore, in order to make the tongue 40 waterproof, a waterproof breathable membrane (not shown), which is sold under the tradename of Goretex or Sympatex), may be disposed between the inner and outer layers 41, 42.

The watertight sealing tape 50 is adhered to the upper 10 and the inner surface of the outer layer 41 of the tongue 40 along the first seam 16 so as to prevent entry of water through the first seam 16. As an option, a waterproof adhesive may be applied to the first seam 16 instead of using the watertight sealing tape 50. As another option, the watertight sealing tape 50 or the waterproof adhesive may be attached to the inner lining 30 and the inner surface of the inner layer 42 of the tongue 40 along the second seam 32.

The eyelet elements 60 are attached to the eyelet plate 14 between the inner and outer edges 141, 142 for attachment of a shoe lace.

Since the outer layer 41 of the tongue 40 is sewn to the eyelet plate 14 along the connection seam 13 and since the inner layer 42 is sewn to the inner lining 30 along the second notched edge 31, the tongue 40 can prevent entry of water into the instep part of the upper 10. In addition, because the tongue 40 is sewn to the upper 10 along the connection seam 13 and is sewn to the inner lining 30 along the second notched edge 31, the tongue 40 shields the eyelet elements 60 at the inner side of the eyelet plate 14. Therefore, water is prevented by the tongue 40 from invading the inside of the upper 10 through the eyelet elements 60. Due to this arrangement, the present invention does not require the conventional waterproof sealing treatment which is needed by the eyelet elements of the conventional shoe and thus simplifies the manufacturing process thereof. Moreover, since the eyelet plate 14 extends outwardly of the tongue 40, the problem of water penetration into the inner lining 30 due to the attachment of the eyelet elements 60 to the eyelet plate 14 can be eliminated.

The eyelet plate 14, which extends outwardly and independently of the tongue 40, may be combined with various configurations of eyelet elements.

The tongue 40 in this embodiment is made of an elastic and stretchable waterproof material, such as neoprene, so that the size thereof can be reduced as compared to the conventional tongue. The stretchable tongue 40 also facilitates entry of the wearer's foot into the shoe.

Figure 5:
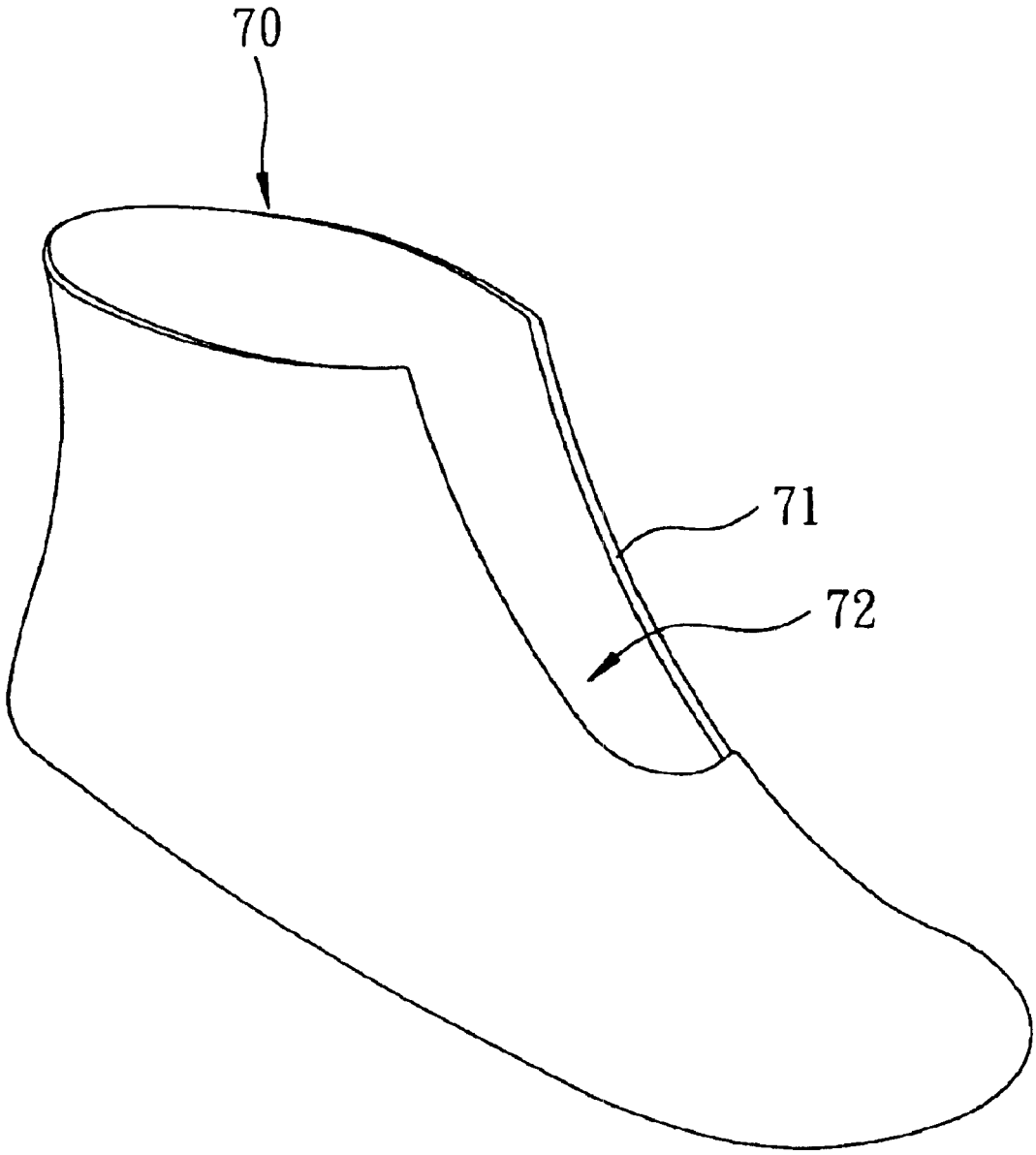
FIG. 5 is a perspective view of a waterproof breathable lining used in the first embodiment.
Figure 6:
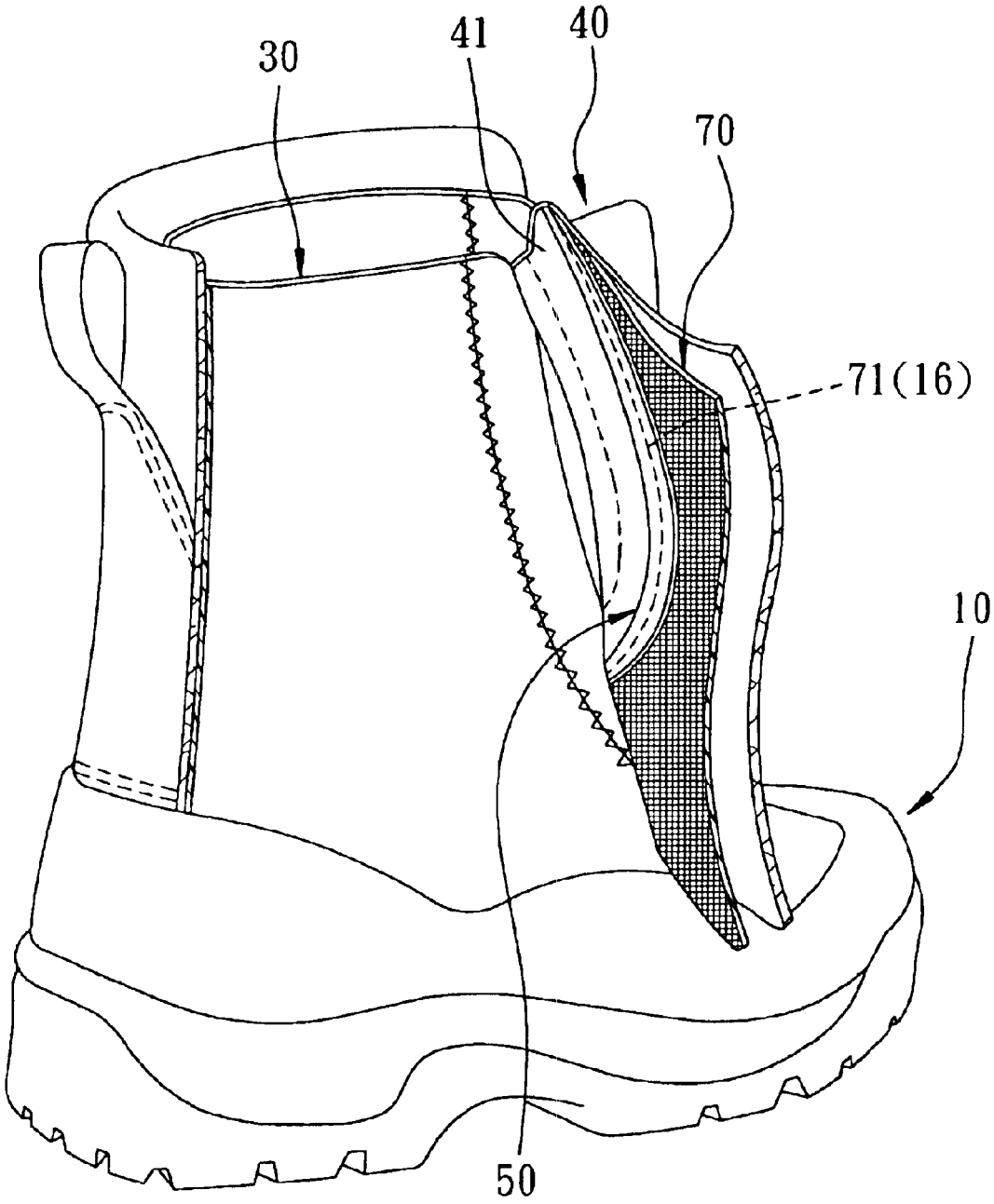
FIG. 6 is a partially sectioned view of a second embodiment of the present invention.

Referring to FIGS. 5 and 6, a second embodiment of the shoe according to the present invention is shown, wherein elements similar to those described in the first embodiment are represented by like reference numerals. The second embodiment differs from the first embodiment in that the second embodiment further includes a waterproof breathable lining 70 disposed between the inner lining 30 and the upper 10. The waterproof breathable lining 70 is shaped as a sock and is provided with a third notched edge 71 having a contour conforming to the marginal end of the tongue 40, and a cutout 72 defined by the third notched edge 71. The upper 10 and the inner lining 30 are sewn together at the top ends thereof. The third notched edge 71 of the waterproof breathable lining 70 is attached to the upper 10 along the first seam 16. The watertight sealing tape 50 is adhered to an inner surface of the waterproof breathable lining 70 and the outer layer 41 of the tongue 40 along the first seam 16.

Figure 7:
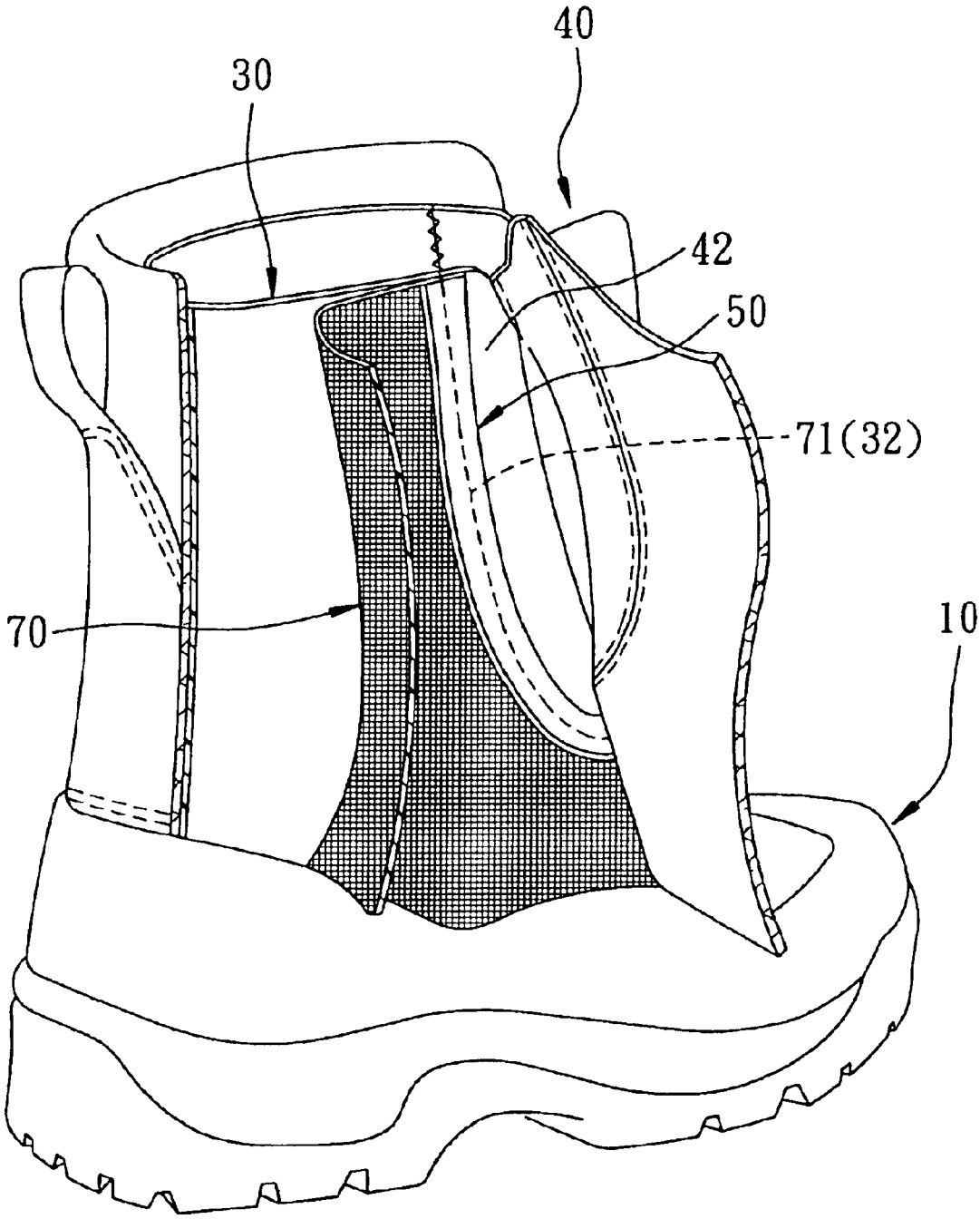
FIG. 7 is a partially sectioned view of a third embodiment of the present invention.

A third embodiment of the shoe according to the present invention is shown in FIG. 7 wherein elements similar to those of the first embodiment are represented by like reference numerals. The third embodiment differs from the second embodiment in that the third notched edge 71 of the waterproof breathable lining 70 is attached to the inner lining 30 along the second seam 32, and the watertight sealing tape 50 is adhered to the outer surface of the waterproof breathable lining 70 and the inner layer 42 of the tongue 40 along the second seam 32.

Figure 8:
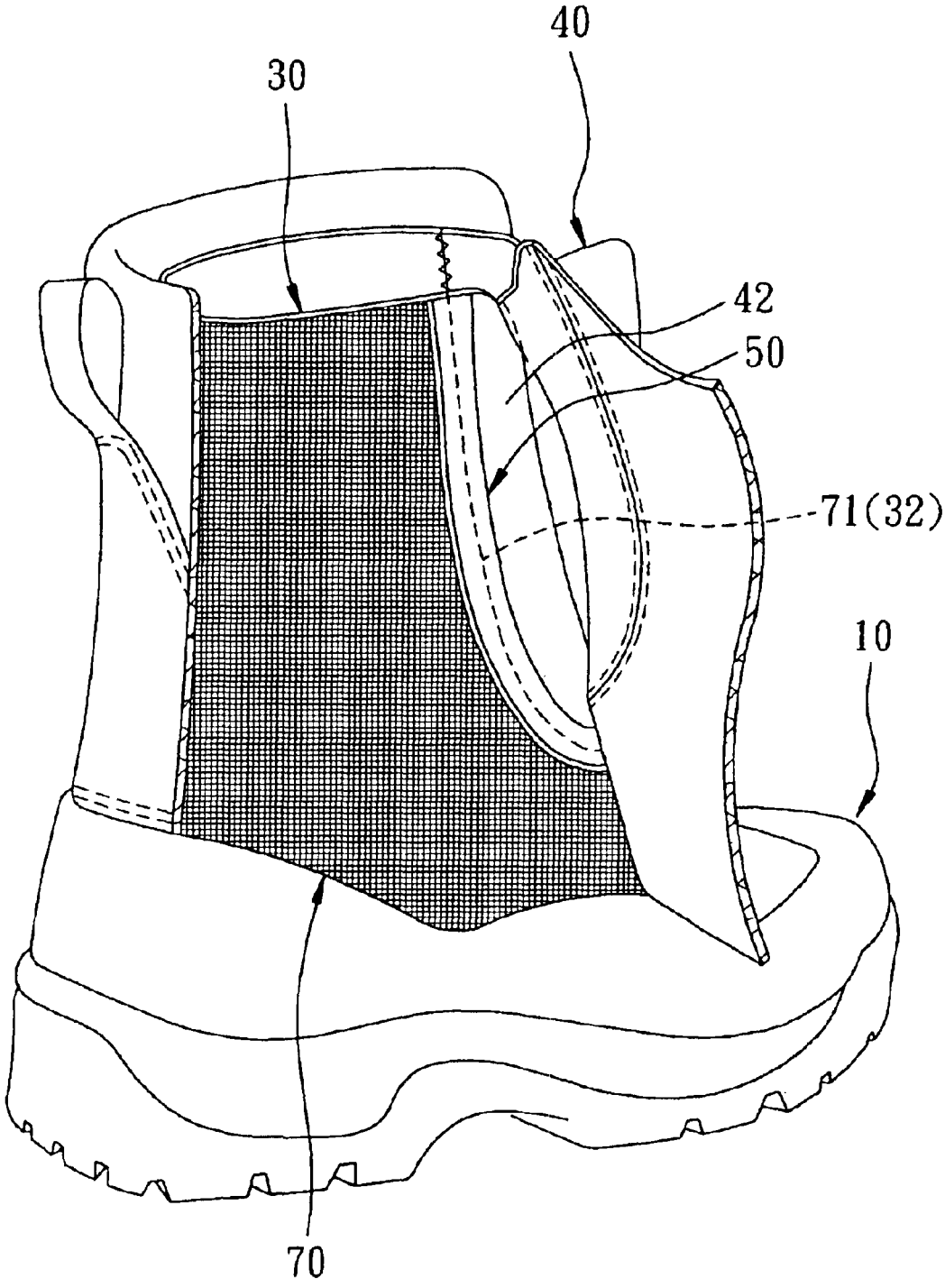
FIG. 8 is a partially sectioned view of a fourth embodiment of the present invention.

Referring to FIG. 8, a fourth embodiment according to the present invention is shown, wherein elements similar to those of the first embodiment are represented by like reference numerals. The fourth embodiment differs from the second embodiment in that the waterproof breathable lining 70 in the fourth embodiment is adhered to the surface of the inner lining 30 before the inner lining 30 is connected to the upper 10.

Figure 9:
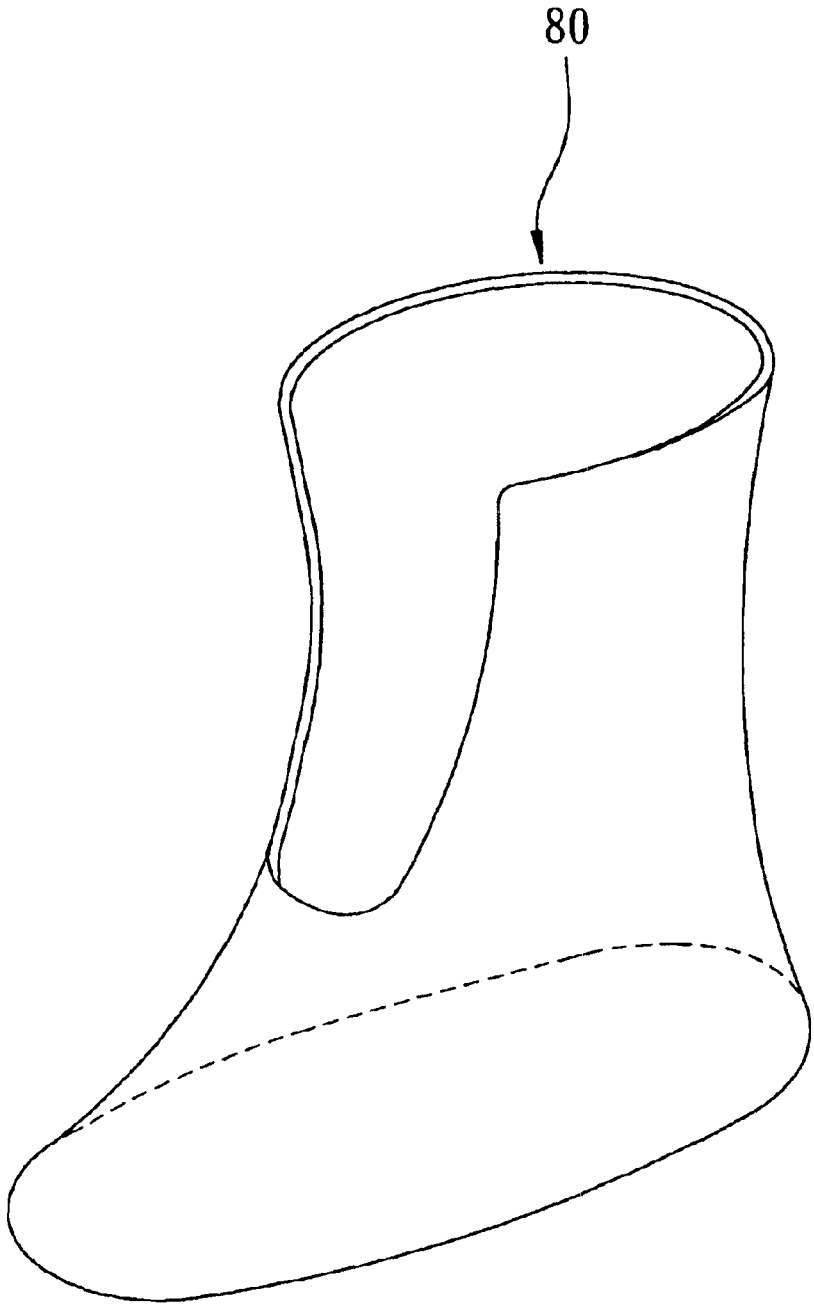
FIG. 9 is the same view as FIG. 5 but with a bottom end of the lining being opened.

Referring to FIG. 9, the shoe according to the present invention may be associated with a waterproof breathable lining 80 in place of the waterproof breathable lining 70 used in the previous embodiments. The waterproof breathable lining 80 is substantially similar to the waterproof breathable lining 70 except that the lining 80 is open at the bottom open end thereof.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

We claim:

1. A shoe comprising:

an upper having a top end, a substantially U-shaped first notched edge extending downward from said top end, a first cutout confined by said first notched edge, and a connection seam extending along and spaced apart from said first notched edge, said connection seam extending around said first notched edge;

an inner lining disposed inside said upper and having a second notched edge;

a tongue which is waterproof and which has a marginal end, said marginal end being contoured to substantially conform to said connection seam, said marginal end being attached to said upper along said connection seam and being attached to said inner lining along said second notched edge, an outer layer with an outer marginal end extending along said marginal end of said tongue, and an inner layer with an inner marginal end extending along said marginal end of said tongue, said cuter marginal end being attached to said upper along said connection seam, thus forming a first seam, said inner marginal end being attached to said inner lining along said second notched edge, thus forming a second seam; and a watertight sealing member adhered to said upper and said tongue along said first seam.

2. A shoe comprising:

an upper having a top end, a substantially U-shaped first notched edge extending downward from said top end, a first cutout confined by said first notched edge, and a connection seam extending along and spaced apart from said first notched edge, said connection seam extending around said first notched edge;

an inner lining disposed inside said upper and having a second notched edge;

a tongue which is waterproof and which has a marginal end, said marginal end being contoured to substantially conform to said connection seam, said marginal end being attached to said upper along said connection seam and being attached to said inner lining along said second notched edge, an outer layer with an outer marginal end extending along said marginal end of said tongue, and an inner layer with an inner marginal end extending along said marginal end of said tongue, said outer marginal end being attached to said upper along said connection seam, thus forming a first seam, said inner marginal end being attached to said inner lining along said second notched edge, thus forming a second seam; and a watertight sealing member adhered to said inner lining and said tongue along said second seam.

3. A shoe comprising:

an upper having a top end, a substantially U-shaped first notched edge extending downward from said top end, a first cutout confined by said first notched edge, and a connection seam extending along and spaced apart from said first notched edge, said connection seam extending around said first notched edge;

an inner lining disposed inside said upper and having a second notched edge;

a tongue which is waterproof and which has a marginal end, said marginal end being contoured to substantially conform to said connection seam, said marginal end being attached to said upper along said connection seam and being attached to said inner lining along said second notched edge, an outer layer with an outer marginal end extending along said marginal end of said tongue, and an inner layer with an inner marginal end extending along said marginal end of said tongue, said outer marginal end being attached to said upper along said connection seam, thus forming a first seam, said inner marginal end being attached to said inner lining along said second notched edge, thus forming a second seam; and a waterproof breathable lining disposed between said inner lining and said upper, said waterproof breathable lining having a third notched edge corresponding in position to said first notched edge, said third notched edge being attached to one of said upper and said inner lining and connected to said tongue.

4. The shoe as claimed in claim 3, wherein said third notched edge is attached to said upper and said outer layer of said tongue along said first seam.

5. The shoe as claimed claim 4, further comprising;

a watertight sealing member disposed along said first seam and adhered to said upper and said waterproof breathable lining.

6. The shoe as claimed in claim 3, wherein said third notched edge is attached to said inner lining and said inner layer of said tongue along said second seam.

7. The shoe as claimed claim 6, further comprising a watertight sealing member disposed along said second seam and adhered to said waterproof breathable lining and said inner layer of said tongue.

* * * * *